US005461943A

United States Patent [19]

Munkel

[11] Patent Number: 5,461,943

[45] Date of Patent: Oct. 31, 1995

[54] CABINET SCRAPER BLADE FILING AND BURNISHING TOOL

[75] Inventor: Kenneth J. Munkel, Des Moines, Iowa

[73] Assignee: Woodsmith Corporation, Des Moines, Iowa

[21] Appl. No.: 134,205

[22] Filed: Oct. 8, 1993

[51] Int. Cl.[6] ..... B24D 15/06

[52] U.S. Cl. ..... 76/89.2; 76/88

[58] Field of Search ..... 76/82, 81, 88, 76/89, DIG. 9, 89.2; 51/181 R, 149, 156, 3

[56] References Cited

U.S. PATENT DOCUMENTS

| | | | |
|---|---|---|---|
| D.14,303 | 9/1883 | Kasson . | |
| D.56,205 | 9/1920 | Graf . | |
| 102,994 | 5/1870 | Webster . | |
| D.123,490 | 11/1940 | Safell . | |
| D.149,342 | 4/1948 | Davis . | |
| D.150,955 | 9/1948 | Jacobs . | |
| D.151,324 | 10/1948 | Chapin et al. . | |
| 207,339 | 8/1878 | Barwick . | |
| D.229,476 | 12/1973 | Farquharson . | |
| D.249,079 | 8/1978 | Soderman et al. . | |
| 441,758 | 12/1890 | Gowdy . | |
| 579,726 | 3/1897 | St. Hilaire . | |
| 612,912 | 10/1898 | Poindexter | 76/88 |
| 823,279 | 6/1906 | Kellogg | 76/88 |
| 940,773 | 11/1909 | Ackermann . | |
| 1,190,718 | 7/1916 | Brunsell et al. . | |
| 1,471,136 | 10/1923 | Borleis . | |
| 1,594,246 | 7/1926 | Dechert | 76/82 |
| 1,936,990 | 11/1933 | Piermann . | |
| 2,069,608 | 2/1937 | Hammond . | |
| 2,115,778 | 5/1938 | Krahenbuhl . | |
| 2,499,331 | 2/1950 | Robitaille . | |
| 4,498,360 | 2/1985 | Milum . | |
| 4,934,110 | 6/1990 | Juranitch . | |
| 5,099,722 | 3/1992 | Lee | 76/88 |

FOREIGN PATENT DOCUMENTS

| | | |
|---|---|---|
| 293785 | 3/1928 | United Kingdom . |

OTHER PUBLICATIONS

Cover Page to U.S. Design Pat. No. 273,360 to Hill, issued Apr. 10, 1984.

Cover Page to U.S. Pat. No. 446,551 to Chamberlain, issued Feb. 17, 1891.

Lee Valley Tool Catalog, pp. 17, 131–132 (1984).

The 1994 Garrett Wade Tool Catalog, Sep. 1993–Sep. 1994, p. 74, item numbered "A," Harris Scraper Blade Conditioner.

Lee Valley Catalog titled Fine Woodworking Tools 1992/93, p. 26, item numbered "E," Veritas™ Jointer/Edger.

Lee Valley Catalog titled Fine Woodworking Tools 1992/93, p. 27, item numbered "A," Veritas™ Variable Burnisher.

Lee Valley Catalog titled Fine Woodworking Tools 1992/93, p. 27, item numbered "B," Veritas™ Tri–Burnisher.

"Hand Scrapers," ShopNotes, Issue 2 (Mar., 1992), pp. 12–15.

*Primary Examiner*—Rinaldi I. Rada

*Attorney, Agent, or Firm*—Kilpatrick & Cody; John S. Pratt

[57] ABSTRACT

A combination cabinet scraper blade edge preparation tool for: (1) filing a scraper blade edge square to its face or, alternatively, at a predetermined angle to the blade face and (2) for burnishing the scraper blade edge at a predetermined burnishing angle relative to the face of the blade. The tool may be easily fabricated because it can be made with a uniform cross-sectional shape and with minimal machining by extruding it from aluminum, among other materials, and using thumb or set screws threaded into the extrusion to fix the file and burnishing rod in position.

17 Claims, 2 Drawing Sheets

CABINET SCRAPER BLADE FILING AND BURNISHING TOOL

BACKGROUND OF THE INVENTION

This invention relates to burnishers, file holders and other devices for preparing cabinet scraper blades for use.

Cabinet scrapers are woodworking tools that are useful for removing fine layers of wood or finish from a work surface. There are two principal types of such scrapers. The first is simply a blade formed from a sheet of flat, typically rectangular steel on the order of 1/32" thick and typically 2½" tall by 5½" to 6" wide. Such scraper blades are used "freehand." Other cabinet scrapers have a plane-like body with a flat sole that bears against the work surface. A rectangular scraper blade projects through a slot in the sole in order to contact the work surface.

The first type of cabinet scraper blade is typically prepared for use by grinding or filing and, optionally, honing the working edge so that it is straight (or smoothly curved in the case of curved scrapers), smooth and square to the face of the scraper. Alternatively, the edge may be beveled at an angle such as 45°. A "hook" is then formed along the scraper edge by drawing a burnisher (typically a hardened steel rod) along that edge or moving the scraper against a burnisher. The burnisher is typically oriented at an angle with respect to the face of the scraper on the order of 75° (i.e., 15° relative to the scraper edge).

The blade for a plane-type cabinet scraper is prepared in a similar manner except that the edge is typically sharpened at a 25° to 30° bevel rather than square to the face of the blade. In each case it is desirable to file the scraper blade edge at a controlled angle relative to its face, and it is desirable to burnish at an angle that does not vary during a burnishing stroke. Previous devices have been developed to accomplish these tasks including, for instance, various handled burnishing rods, the variable burnisher described in U.S. Pat. No. 5,099,722 and devices for holding a file square to a fence against which the face of a scraper blade rides while its edge is filed. Such prior devices do not, however, simply and economically include burnishing and file holding apparatus in a single device or simultaneously accommodate in the same device means for preparing the edges of both of the above-described types of scraper blades.

SUMMARY OF THE INVENTION

The present invention is a combination scraper blade edge preparation tool for: (1) filing a scraper blade edge square to its face or, alternatively, at a predetermined angle to the blade face and (2) for burnishing a scraper blade edge at a predetermined angle relative to the face of the blade.

The present invention is economically manufactured with as few as five parts (plus a standard file) by utilizing a section of aluminum extrusion having a uniform cross section. The body of the tool formed by the section of aluminum extrusion provides a first position or pocket in which set screws hold the file square to a first scraper blade fence for filing a square edge on the blade. The body also provides a second position for the scraper blade so that the file is oriented at a predetermined angle between approximately 20° and 45° relative to a second fence. This may be accomplished by repositioning the file to a second location adjacent to a second fence. Alternatively, a second fence may be formed in a position that permits such a predetermined bevel angle to be filed on a blade without changing the file location. Finally, one or more holes for receiving a round burnishing rod fixed in a selected one of the holes by a set screw are positioned adjacent to a third fence. The longitudinal axis of each hole (and, therefore, of a burnishing rod positioned in the hole) is oriented at a different predetermined angle (typically between 1° and 15°) relative to the fence. Burnishing is accomplished by drawing the scraper along the burnishing rod while the scraper rides against the burnishing fence. The apparatus may conveniently be mounted on a workbench with wood screws that pass through its body and into the bench.

DETAILED DESCRIPTION OF THE DRAWINGS

Figure 1:
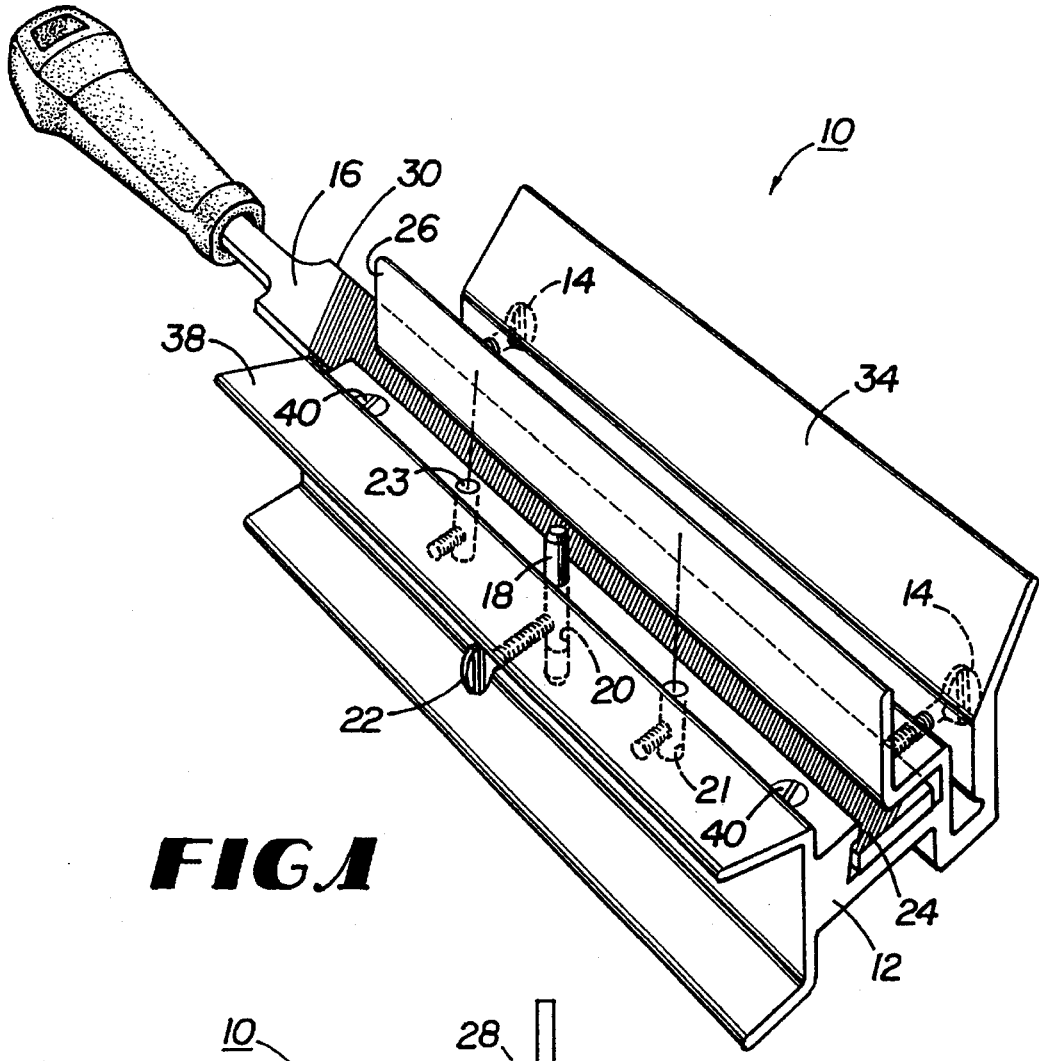
FIG. 1 is a perspective view of a first embodiment the combination cabinet scraper blade filing and burnishing tool of the present invention with a file shown in position for preparing a square edge scraper blade.
Figure 2:
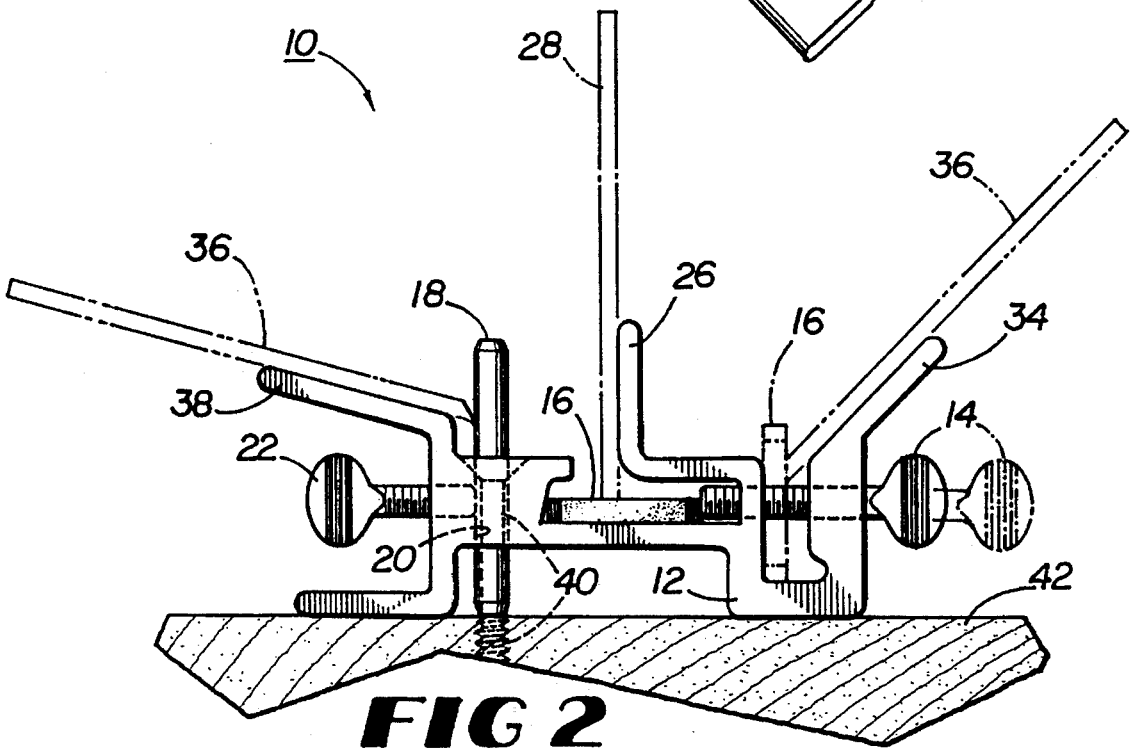
FIG. 2 is an end elevation view of the cabinet scraper blade filing and burnishing tool shown in FIG. 1 with one of the burnishing rod holes and the fixing screw holes through the body of the tool shown in broken lines and the three possible positions of cabinet scrapers during use of the tool also shown in broken lines.

As is illustrated in FIGS. 1 and 2, the first embodiment of the combination cabinet scraper blade edge filing and burnishing tool 10 of the present invention includes a tool body 12, two thumb or set screws 14 for holding file 16 within the body 12, a burnishing rod 18 positioned in a hole 20 in body 12 and a thumb or set screw 22 to hold burnishing rod 18 in place. Alternative holes 21 and 23 with longitudinal axes oriented differently from that of hole 20 and each other provide the opportunity to burnish at different angles simply by moving burnishing rod 18 to a different hole oriented at a different desired angle relative to burnishing fence 38.

As will be appreciated by reference to FIG. 2, file 16 may be held within body 12 by set screws 14 acting against an edge 30 of file 16 so that the file is rigidly fixed with its face 24 oriented square to a first fence 26 of body 12 against which a scraper blade 28 is slid in order to file a square edge on scraper blade 28. File 16 may alternatively be held within body 12 by set screws 14 acting against face 24 of file 16 while it is adjacent to fence 34, thereby permitting a beveled edge to be filed on scraper 36 as it is slid along fence 34.

Either of scraper blades 28 or 36 can then be further dressed if desired, for instance, on a whetstone and then may be burnished by passing the edge to be burnished against burnishing rod 18 with the blade 28 against a third burnishing fence 38.

Figure 3:
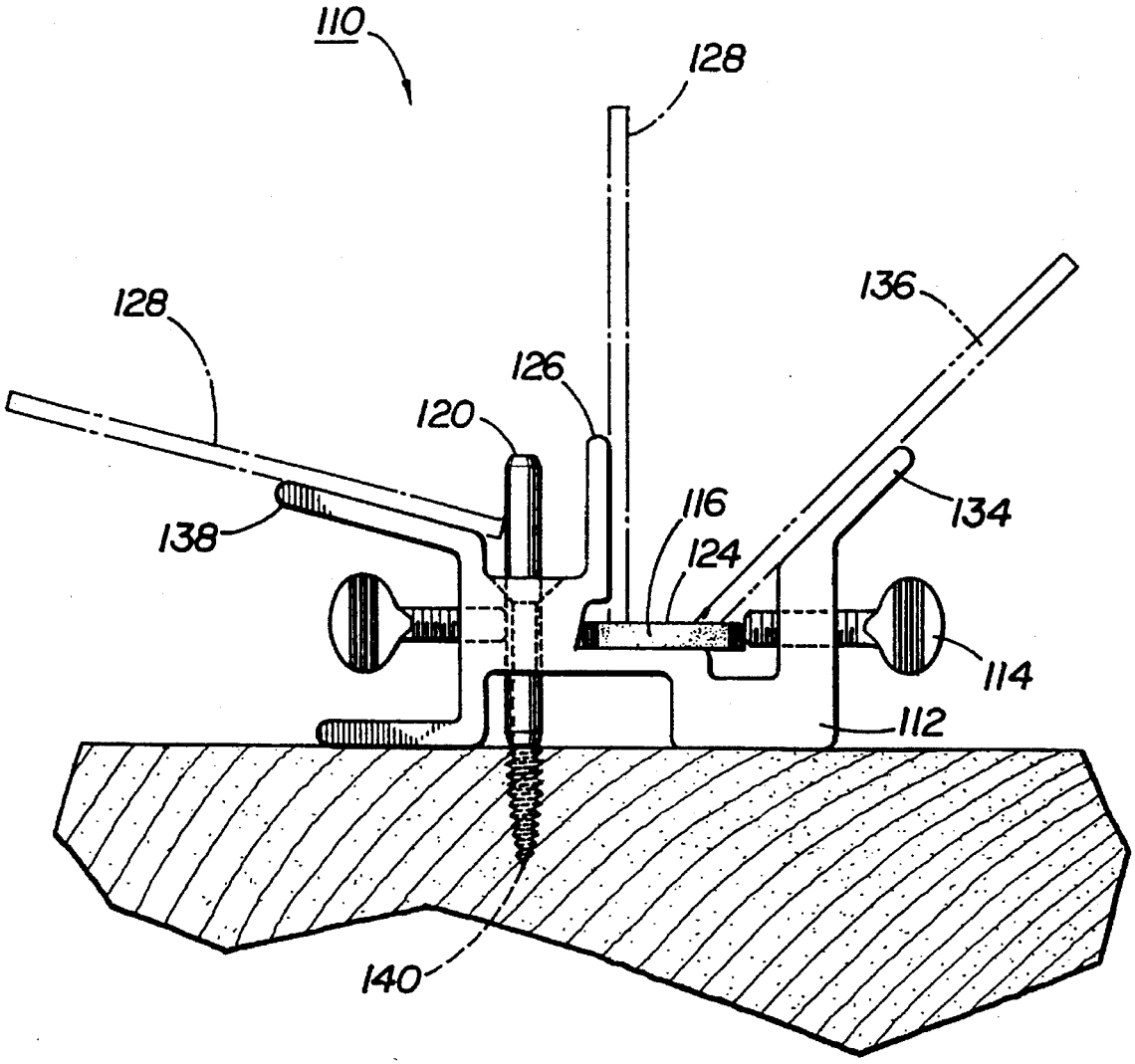
FIG. 3 is an end elevation view similar to FIG. 2 of an alternative embodiment of the combination cabinet scraper blade filing and burnishing tool of the present invention in which square and bevel edge filing is possible without moving the file.

Alternative configurations of the combination cabinet scraper blade filing and burnishing tool of the present invention may be fabricated, such as the alternative embodiment illustrated in FIG. 3. The tool 110 in FIG. 3 includes a body 112 within which set screws 114 removably secure a file 116 in a single position in which the face 124 is square to a first fence 126 and at a predetermined angle to a second fence 134 so that the edge of a scraper 128 may be filed square or the edge of a scraper 136 may be beveled. Scraper 128 may be burnished by sliding the scraper 128 along burnishing fence 138 so that the edge of the scraper 128 contacts and slides across a burnishing rod 120.

While tool bodies 12 and 112 could be fabricated in other manners, the configuration illustrated in FIGS. 1 and 2 can probably most easily be formed by extruding body 12 of aluminum, or extruding, pulltruding or molding it of plastic, fiber reinforced plastic, a composite material or another suitable material having adequate strength and rigidity. Screws 40 and 140 may pass into a workbench top 42 or other secure work surface to hold tool 10 during use. By securing a section of "2×4" lumber to the underside of tool 10, by passing screws 40 into the edge of such a section, the tool 10 may be clamped in a vise during use by grasping the lumber between the vise jaws.

While files 16 and 116 are shown in the illustrations as metal files, they could also be one of numerous other planar abrasive devices such as diamond files and synthetic or natural abrasive stones. Additionally, successively finer files 16 and 116 or other planar abrasive devices can be mounted in bodies 12 and 112 during use of tools 10 and 110 in order to refine scraper blade edges before burnishing.

The foregoing description of this invention is for purposes of explanation and illustration. It will be apparent to those skilled in the art that modification and changes may be made to this invention without departing from its scope and spirit.

I claim:

1. A cabinet scraper blade edge preparation tool comprising:

(a) means for abrading the edge of the scraper blade;

(b) means for burnishing the blade edge of the scraper blade, wherein the burnishing means comprises a burnishing rod;

(c) first means for supporting the blade edge of the scraper blade at a fixed and acute burnishing angle relative to the burnishing means, wherein the first means comprises means for alternatively holding the burnishing rod in a variety of relationships to a burnishing fence that supports the scraper blade; and (d) second means for supporting the edge of the scraper blade at a fixed abrading angle relative to the abrading means.

2. A cabinet scraper blade edge preparation tool, comprising a first, second and third fence, a planar abrasive means, a burnishing means and a body, extruded from aluminum in which a plurality of set screws are threaded, whereby (a) at least one of the screws is adapted to hold the planar abrasive means in a fixed relationship to the first fence, (b) at least one of the screws is adapted to hold the planar abrasive means in a fixed relationship to the second fence, and (c) at least one of the screws is adapted to hold the burnishing means in a fixed relationship to the third fence.

3. The cabinet scraper blade edge preparation tool of claim 2, wherein the third fence is oriented at a different angle to the abrasive means than the first fence.

4. The cabinet scraper blade edge preparation tool of claim 2, wherein the planar abrasive means is a file.

5. The cabinet scraper blade edge preparation tool of claim 2, wherein the first fence is oriented at substantially 90° to the planar abrasive means, the burnishing means comprises a burnishing rod having a longitudinal axis and the second fence is oriented at an angle between approximately 1° and 20° to the longitudinal axis of the burnishing rod, and the third fence is oriented at an angle between approximately 20° and 45° to the planar abrasive means.

6. The cabinet scraper blade edge preparation tool of claim 2, wherein the burnishing means comprises a burnishing rod and the body comprises a plurality of burnishing rod holes for selectively holding the burnishing rod, each of which has a longitudinal axis oriented at a different angle to the third fence, so that different burnishing angles may be selected by positioning the burnishing rod in the hole having the desired angle.

7. A cabinet scraper blade edge preparation tool, comprising an extruded aluminum body formed with:

(a) two pockets to hold a file within the body with a plurality of set screws threaded into the body to bear against the file, (b) a hole within the body to receive a burnishing rod removably fixable within the hole with a set screw threaded into the body to intersect the hole, (c) a first fence oriented at substantially 90° to an abrasive face of the file when it is fixed in the first pocket, (d) a second fence oriented at substantially 45° to the abrasive face of the file when it is fixed in the second pocket, and (e) a burnishing fence oriented at substantially 15° to the longitudinal axis of the hole.

8. The cabinet scraper blade edge preparation tool of claim 7, further comprising a plurality of holes in the body for receiving screws for fixing the body to a support surface during use.

9. The cabinet scraper blade edge preparation tool of claim 7, further comprising a plurality of burnishing rod holes within which the rod may alternatively be fixed, each of which has a longitudinal axis oriented at a different angle to the burnishing fence, so that different burnishing angles may be selected by positioning the burnishing rod in the hole having the desired angle relative to the burnishing fence.

10. A cabinet scraper blade edge preparation tool, comprising:

(a) a generally planar abrasive device for abrading the blade edge of a scraper blade;

(b) a first fence, oriented at a first angle relative to the abrasive device, for supporting the scraper blade;

(c) a second fence, oriented at a second angle relative to the abrasive device, for supporting the scraper blade;

(d) means for holding the abrasive device in a fixed relationship to the first fence;

(e) means for burnishing the blade edge; and (f) means for supporting the scraper blade at a fixed abrading angle relative to the burnishing means.

11. The cabinet scraper blade edge preparation tool of claim 10, wherein the burnishing means comprises a burnishing rod and the supporting means comprises means for holding the burnishing rod in a fixed relationship to a burnishing fence of the tool.

12. The cabinet scraper blade edge preparation tool of claim 11, wherein the burnishing rod holding means comprises a body containing a hole within which the burnishing rod is fixed.

13. The cabinet scraper blade edge preparation tool of claim 12, further comprising a plurality of burnishing rod holes within which the rod may alternatively be fixed, each of which has a longitudinal axis oriented at a different angle to the burnishing fence, so that different burnishing angles can be selected by positioning the burnishing rod in the hole having the desired angle.

14. The cabinet scraper blade edge preparation tool of claim 11, wherein the burnishing rod holding means comprises a hole for accepting the burnishing rod and wherein the abrasive device has an abrasive face, the first fence is oriented at substantially 90° to the abrasive face, the burnishing rod hole has a longitudinal axis and the burnishing fence is oriented at an angle between approximately 1° to 20° to the longitudinal axis of the burnishing rod accepting hole, and the second fence is oriented at an angle between approximately 20° and 45° to the abrasive face.

15. The cabinet scraper blade edge preparation tool of claim 10, wherein the abrasive device holding means comprises a body extruded from aluminum and a plurality of set screws threaded into the body.

16. A cabinet scraper blade edge preparation tool, comprising a planar abrasive means, a plurality of fences associated with the planar abrasive means, a burnishing means and a body, capable of holding:

(a) the planar abrasive means in a fixed relationship to a first one of the fences capable of supporting a scraper blade, (b) the planar abrasive means in a fixed relationship to a second one of the fences capable of supporting the scraper blade, and (c) the burnishing means in a variety of positions in each of which the burnishing means is at an acute angle relative to a third one of the fences capable of supporting the scraper blade.

17. The cabinet scraper blade edge preparation tool of claim 16 wherein the body is extruded from aluminum and a plurality of set screws are threaded into holes in the body.

* * * * *